United States Patent [19]

Nguyen et al.

[11] Patent Number: 4,787,876

[45] Date of Patent: Nov. 29, 1988

[54] TOY MUSICAL PLAYSET

[75] Inventors: Tuyen Nguyen, Los Angeles; Donald E. Herring, Redondo Beach, both of Calif.

[73] Assignee: Mattel, Inc., Hawthorne, Calif.

[21] Appl. No.: 159,634

[22] Filed: Feb. 23, 1988

[51] Int. Cl.[4] ..... A63H 5/00

[52] U.S. Cl. ..... 446/408; 446/418

[58] Field of Search ..... 446/143, 404, 408, 418, 446/419, 421, 481; D7/19, 354, 399; D21/122

[56] References Cited

U.S. PATENT DOCUMENTS

| | | | |
|---|---|---|---|
| 264,066 | 9/1982 | Crandall | 434/159 |
| D. 270,887 | 10/1983 | Allgeyer et al. | D7/19 |
| D. 287,984 | 1/1987 | Thomson et al. | D21/122 |
| 298,633 | 5/1984 | Snow | 239/36 |
| 2,235,801 | 3/1941 | Herlihy | 434/433 |
| 2,278,894 | 4/1942 | Paulson | 446/117 |
| 2,289,314 | 7/1942 | Davis | 446/419 |
| 2,458,306 | 1/1949 | Schneider | 273/1 GF |
| 2,616,218 | 11/1952 | Brown | 446/418 |
| 2,839,842 | 6/1958 | Keyko | 434/259 |
| 2,848,839 | 8/1958 | Haines | 446/418 |
| 2,936,544 | 5/1960 | Kohner | 446/117 |
| 3,139,698 | 7/1964 | Arnold | 446/124 |
| 3,159,403 | 12/1964 | Glass et al. | 273/272 |
| 3,433,110 | 1/1966 | Stanton | 84/102 |
| 3,532,022 | 10/1970 | Gemin | 84/102 |
| 3,533,323 | 10/1970 | Baxter | 84/102 |
| 3,545,798 | 12/1970 | Swett | 403/326 |
| 3,548,702 | 12/1970 | Kosuge | 84/102 |
| 3,590,679 | 7/1971 | Law | 84/102 |
| 3,909,977 | 11/1975 | Kirk | 446/418 |
| 4,038,914 | 8/1977 | Crespo et al. | D7/399 |
| 4,129,963 | 12/1978 | Perry, Jr. et al. | 446/325 |
| 4,150,602 | 4/1979 | Santiago, Sr. | 446/421 |
| 4,179,973 | 12/1979 | White | 84/402 |
| 4,383,386 | 5/1983 | Giordano et al. | 446/317 |
| 4,485,585 | 12/1984 | Shackelford et al. | 446/117 |
| 4,509,920 | 4/1985 | Kaufmann | 434/159 |
| 4,604,073 | 8/1986 | Livesey et al. | 446/117 |

FOREIGN PATENT DOCUMENTS

| | | |
|---|---|---|
| 482946 | 4/1938 | United Kingdom . |
| 578539 | 7/1946 | United Kingdom . |
| 2098495 | 11/1982 | United Kingdom . |

OTHER PUBLICATIONS

Rogers Drums, U.S.A., catalog 64R.
Latin Percussion Inc., U.S.A., The Torpedo.

*Primary Examiner*—Robert A. Hafer
*Assistant Examiner*—Michael Brown
*Attorney, Agent, or Firm*—Ronald M. Goldman; Melvin A. Klein

[57] ABSTRACT

A toy musical playset having a teapot with xylophone keys which is filled with styrene plastic beads, a number of pots with xylophone keys and a pan with a xylophone key, tambourine symbols and musical ribs. The pots, pan and teapot may be stacked on top of each other. The toy pan may be used like a tambourine, or the musical ribs may be used with a toy spatula or spoon to make musical sounds. In addition, the toy teapot filled with beads may be shook to produce musical sounds. A child may strike the xylophone keys with a spoon producing musical sounds during play when the pots, pan and teapot are in a stacked configuration, or when they are spread out on top of a table. The pots or pan may also be hung on a child's belt.

7 Claims, 3 Drawing Sheets

TOY MUSICAL PLAYSET

BACKGROUND OF THE INVENTION

The present invention relates generally to musical toys and, more particularly, to a toy musical playset having a tea pot with xylophone keys which is filled with beads, a number of pots with xylophone keys and a pan with a xylophone key, tambourine symbols and musical ribs, all of which may be stacked on top of each other or used with a toy spatula or spoon to make musical sounds.

In the past, a variety of musical or sound-producing toys have been fabricated. For example, U.S. Pat. Nos. 3,590,679 issued to Law on July 6, 1971; 3,548,702 issued to Kosuge on Dec. 22, 1970; 3,533,323 issued to Baxter on Oct. 13, 1970; 3,532,022 issued to Genin on Oct. 6, 1970; and 3,433,110 issued to Stanton on Mar. 18, 1969 all disclose toy railroad tracks having sound emitting bodies or xylophone—like keys which may be used to play musical tunes. U.S. Pat. Nos. 3,909,977 issued to Kirk on Oct. 7, 1975; 2,848,839 issued to Haines on Aug. 26, 1958; and 2,616,218 issued to Brown on Nov. 4, 1952 describe musical spoons and a noise-making lapper. U.S. Pat. No. 4,179,973 issued to White on Dec. 25, 1979; Rogers Drums Catalog, 64R, page 82; and the publication: The Torpedo, Latin Percussion, Inc., Jan. 7, 1975, show musical instruments or shakers. U.S. Pat. No. 4,383,386 issued to Giordano et al on May 17, 1983 describes a toy skillet and knife having sound-producing capabilities. U.S. Pat. No. 2,289,314 issued to Davis on July 7, 1972; and British Pat. No. 578,539, dated July 2, 1946, both disclose toy rattles.

Toys having parts which may be stacked on top of each other are disclosed in U.S. Pat. Nos. 4,604,073 issued to Livesey et al on Aug. 5, 1986; 4,509,920 issued to Kaufmann on Apr. 9, 1985; 4,485,585 issued to Shackelford et al on Dec. 4, 1984; 4,129,963 issued to Perry Jr. et al on Dec. 19, 1978; 3,159,403 issued to Glass et al on Dec. 1, 1964; 2,936,544 issued to Kohner on May 17, 1960; 2,839,842 issued to Keyko on June 24, 1958; 2,458,306 issued Schneider on Jan. 4, 1949; 2,278,894 issued to Paulson on Apr. 7, 1942; 2,235,801 issued to Herlihy on Mar. 18, 1941; 298,633 issued to Snow on May 13, 1884; and 264,066 issued to Crandall on Sept. 12, 1882. Other stacking toys are described in British Patent Application No. 8213682 of Yakushiin published Nov. 24, 1982; and British Pat. No. 482,946 of Wilkinson dated Apr. 4, 1938. Finally, toys having engaging parts which may be taken apart are shown in U.S. Pat. Nos. 3,545,798 issued to Swett et al on Dec. 8, 1970; and 3,139,698 issued to Arnold on July 7, 1964.

The above patents do not disclose a toy musical playset having a teapot filled with beads, pots with xylophone keys and a pan with a xylophone key, tambourine symbols and musical ribs which may be stacked on top of each other for storage or during play. A child may make musical sounds with a toy spoon using the xylophone keys while the pots, pan and teapot are stacked in a vertical column. Alternatively, the pots, pan and teapot may be unstacked and spread out on top of a table, allowing a child to play musical tunes using the xylophone keys. In addition, the pan with tambourine symbols or the teapot full of beads may be shook in order to produce musical sounds. A child may also make musical sounds by stroking the musical ribs on the pan with a toy spatula. Additional play options would be provided if a child was able to hang the pots or pan on his or her belt. Accordingly, there is a need in the toy manufacturing arts for such a toy musical playset.

SUMMARY OF THE INVENTION

It is an object of this invention to provide a toy musical playset having a teapot with xylophone keys which is filled with beads, pots with xylophone keys, a pan with a xylophone key, tambourine symbols and musical ribs, and toy spoons or spatulas which may be used in conjunction with the pots, pan and teapot to make musical sounds.

It is another object of this invention to provide a toy musical playset having pots, a pan and a teapot which may be stacked on top of each other.

It is another object of this invention to provide a toy musical playset having pots, a pan and a teapot with xylophone keys which may be used with a toy spoon to produce musical sounds when the pots, pan and teapot are stacked on top of each other or spread out on top of a table.

It is still another object of this invention to provide a toy musical playset having pots and a pan which may be hung on a child's belt.

It is still another object of this invention to provide a toy musical playset having a teapot filled with styrene plastic beads and a pan with tambourine symbols which may be shook to produce musical sounds.

These and other objects and advantages are attained by a toy musical playset having a teapot with xylophone keys which is filled with styrene plastic beads, a number of pots with xylophone keys and a pan with a xylophone key, tambourine symbols and musical ribs. The pots, pan and teapot may be stacked on top of each other. The toy pan may be used like a tambourine, or the musical ribs may be used with a toy spatula or spoon to make musical sounds. In addition, the toy teapot filled with beads may be shook to produce musical sounds. A child may strike the xylophone keys with a spoon producing musical sounds during play when the pots, pan and teapot are in a stacked configuration, or when they are spread out on top of a table. The pots or pan may also be hung on a child's belt.

The various features of the present invention will be best understood together with further objects and advantages by reference to the following description of the preferred embodiment taken in connection with the accompanying drawings.

DESCRIPTION OF THE PREFERRED EMBODIMENT

The following specification taken in conjunction with the drawings sets forth the preferred embodiment of the present invention in such a manner that any person skilled in the toy manufacturing arts can use the invention. The embodiment of the invention disclosed herein is the best mode contemplated by the inventors for carrying out their invention in a commercial environment, although it should be understood that various modifications can be accomplished within the parameters of the present invention.

Figure 1:
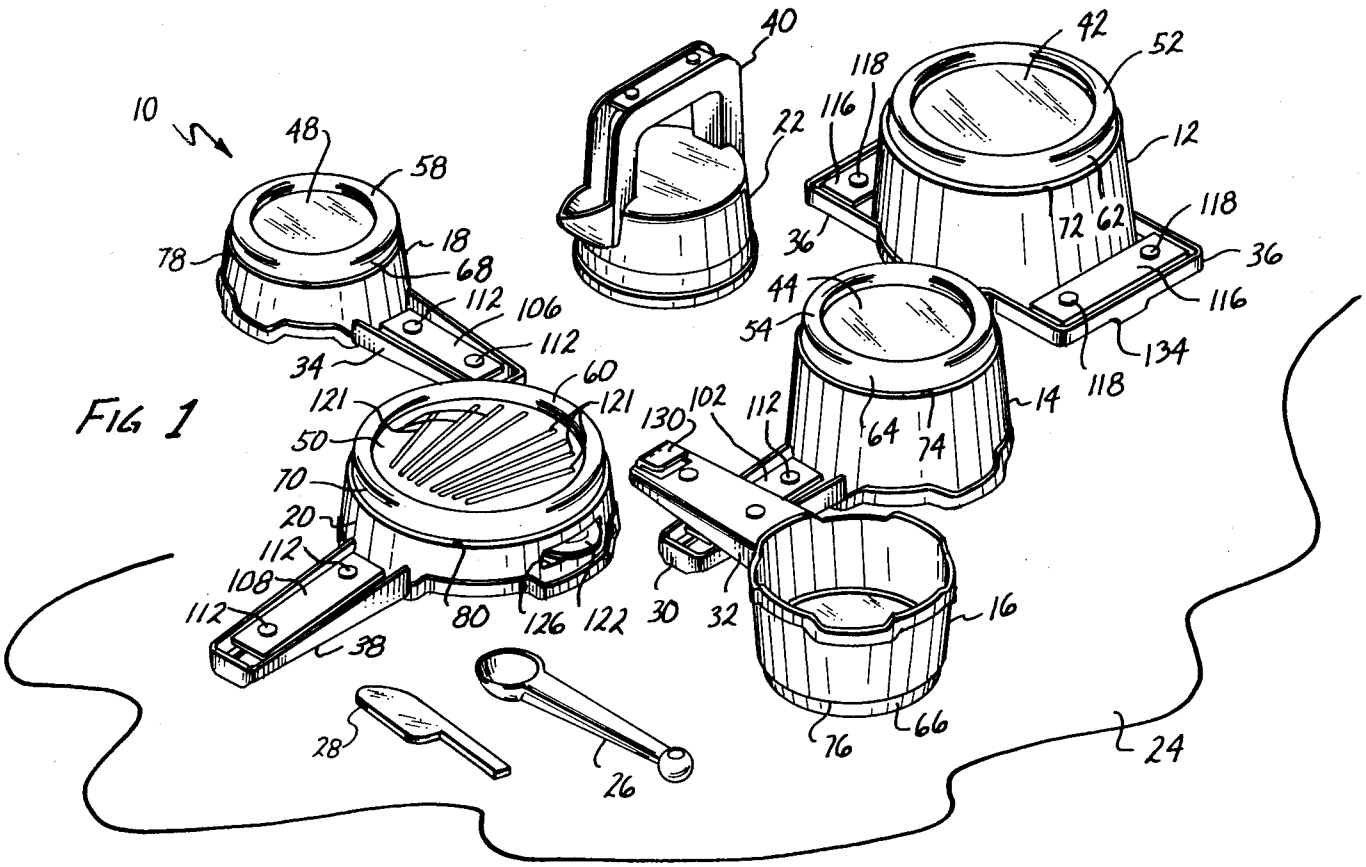
FIG. 1 is perspective view of the preferred embodiment of a a toy musical playset showing a number of pots, a pan, a teapot, and a spoon and spatula spread out on top of a flat surface.

Referring now to the drawings and particularly to FIG. 1, a preferred embodiment of the toy musical playset 10 of the present invention is shown. A number of toy pots 12, 14, 16 and 18, a toy pan 20 and a toy teapot 22 are shown spread out on top of a surface 24 such as a table. Also, shown lying on the surface 24 are a toy spoon 26 and spatula 28. The pots 12 through 18, pan 20, teapot 22, spoon 26 and spatula 28 make up the toy musical playset 10. Preferably, pots 12 through 18 gradually decrease in size from pot 12, which is the largest pot, to pot 18, the smallest pot. Pots 14 through 18, preferably, each have one handle as shown in FIG. 1; reference numerals 30, 32 and 34, respectively, are used for the handles. Pot 12, preferably, has two identical handles 36, and pan 20 and teapot 22, preferably, have handles 38 and 40, respectively.

It is important to note that any number of pots or pans may be used for the playset 10. Also, any number of handles may be used for any pot or pan. Finally, more than one spoon 26 or spatula 28 may be used for the playset 10 if desired.

As shown in FIGS. 1 through 4, pan 20 and pots 12 through 18 have generally truncated conical shapes, each being hollow and, preferably, of generally uniform wall thickness having its upper end open and its bottom end closed by a bottom portion 50, 42, 44, 46, or 48, respectively. Formed integrally with the bottom portions 50, 42, 44, 46 and 48 of each pot and pan are annular portions 60, 52, 54, 56 and 58, respectively, each having a generally conically-shaped outside surface 70, 62, 64, 66 or 68, respectively. As best seen from FIGS. 1 and 3, pan 20 and pots 12 through 18 have annular ledges 80, 72, 74, 76 and 78 respectively, adjacent annular portions 60 and 52 through 58, respectively.

Figure 3:
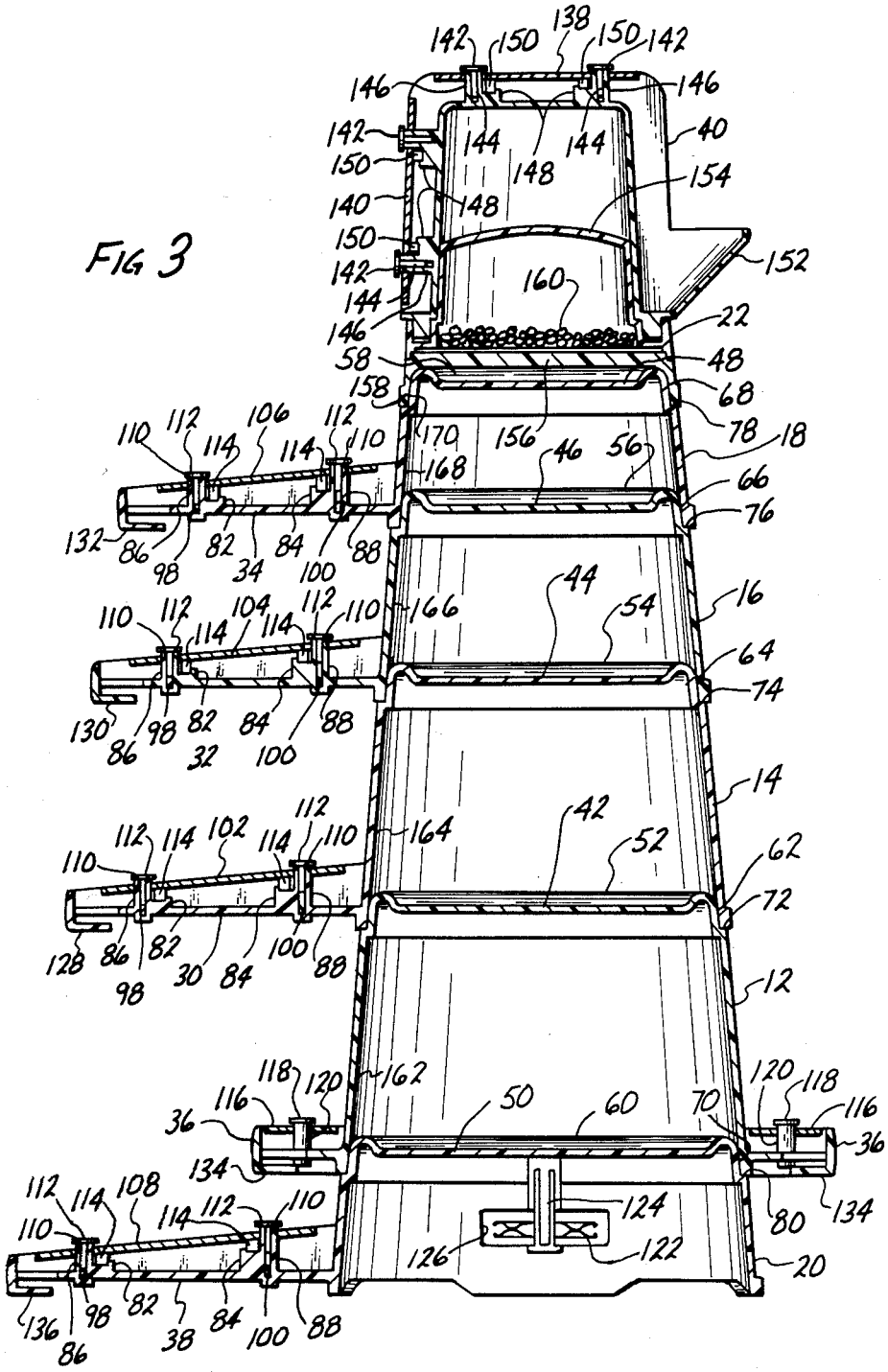
FIG. 3 is a cross-sectional view of the stacked pots, pan and teapot of FIG. 2.

Handles 30, 32, 34 and 38 are preferably of similar design. As shown in FIG. 3 each handle has two integrally formed support portions 82 and 84 with posts 86 and 88 extending upward therefrom (when the pots and pan are positional as shown in FIG. 3). The posts 86 and 88 have apertures 90 and 100, respectively, therein. Handles 30, 32, 34 and 38 have xylophone keys 102, 104, 106 and 108, respectively, connected thereto, each of which has two apertures 110 therein. Posts 86 and 88 engage apertures 110 in the keys 102 through 108, and fasteners 112, which engage apertures 98 and 100 in the posts, are used to connect the keys to handles 30, 32, 34 and 38. Any type of fastener may be used. Foam rubber inserts 114 fit between the xylophone keys 102 through 108 and the support portions 82 and 84 as shown in FIG. 3, cushioning the keys when the same are struck with one of the spoons 26 in order to allow the keys to vibrate producing musical sounds or notes as will be explained later.

Handles 36 of pot 12 also have xylophone keys 116 which are connected to the handles by fasteners 118 that engage posts 120, preferably, in the same manner that fasteners 112 engage posts 86 and 88. In addition, keys 116 are cushioned by foam rubber inserts (not shown), preferably, similar to the way inserts 114 cushion keys 102 through 108.

Figure 2:
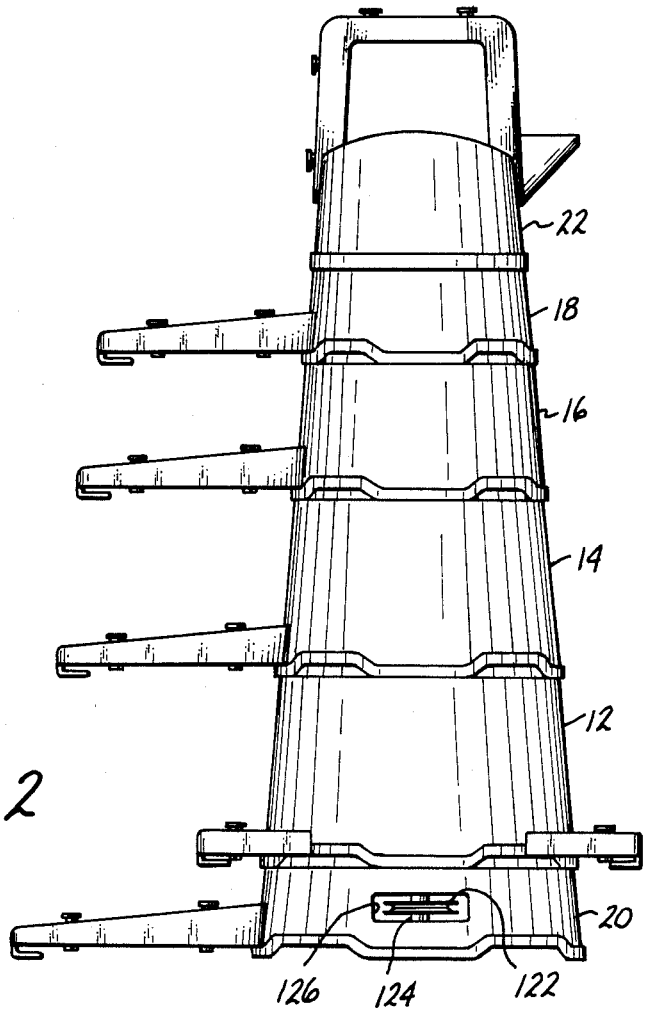
FIG. 2 is an elevational view of the pots, pan and teapot stacked on top of each other.

Referring to FIGS. 1 through 3, pan 20 has tambourine symbols 122 at both sides thereof (note that only one of the two symbols 122 is shown in FIG. 1). The symbols 122 are mounted on posts 124 attached inside the pa 20 and extend outside the pan through apertures 126 in both sides of the pan. The symbols 122 are engaged to posts 124 in such a way that they are free to slide up and down the posts so that musical sounds are produced when the pan 20 is shook or struck as will be explained later. Pan 20 also has a number of musical ribs 121 attached to the outside surface of bottom portion 50 as shown in FIG. 1 which may be used with the spoon 26 or spatula 28 to produce musical sounds as will be explained later.

Handles 30 through 38 each have belt hooks 128 through 136, respectively. Hooks 128 through 136 may be used to hang the pots and pan on a child's belt as will be explained later.

Handle 40 of teapot 22 has two xylophone keys 138 and 140 connected to it. Similar to keys 102 through 108, each of keys 138 and 140 are connected to handle 40 by fasteners 142 which engage apertures 144 in posts 146 extending outward from support portions 148, and are cushioned by foam rubber inserts 150. Note that handle 40 has a simulated pouring spout 152. The teapot 22 has a hollow body portion 154 which is attached to handle 40 and a bottom portion 156. Portion 156 has a downwardly extending annular portion 158 with an open lower end. Beads 160 are located inside hollow body portion 154. The beads 160 are preferably made out of styrene plastic and are used to make musical sounds when the teapot 22 is shook as will be explained later. However, the beads 160 may be made out of any desirable material.

FIGS. 2 and 3 show how the pots 12 through 18, pan 20 and teapot 22 may be stacked on top of each other. When so stacked, pan 20 is supported on a flat surface while the open ends of pots 12 through 18 and of downwardly extending portion 158 (of teapot 22) rest on top of annular ledges 80, 72, 74, 76 and 78, respectively. To facilitate stacking, pots 12 through 18 gradually decrease in size from pot 12, the largest pot, to pot 18, the smallest pot, and conically-shaped inside surfaces 162 through 170 of pots 12 through 18 and portion 158, respectively, are sized to operably and rotatably engage corresponding conically-shaped outside surfaces 70 and 62 through 68, respectively, of annular portions 60, 52, 54, 56 and 58. While in a stacked configuration, the handles of the pots, pan or teapot may be rotated to any desired positions. As such, the pots, pan and teapot may be easily and conveniently stacked during play, or for storage or other purposes.

The pots 12 through 18, pan 20 and teapot 22 are preferably made out of styrene plastic. However, any suitable material may be used.

The toy musical playset 10 may be played with as follows. A child may spread out the pots 12 through 18, pan 20 and teapot 22 on top of a table so that the xylophone keys 102 through 108, 116, 138 and 140 are readily accessible and in some desired order. The child may then use the spoon 26 or any other suitable instrument to stike the keys, causing the keys to vibrate so that musical sounds or notes will be produced. Preferably, the keys are fabricated so that each key produces a different musical sound or note on a musical scale when struck so that the child may use the keys to play different musical tunes. The musical ribs 121 of pan 20 may also be stroked by the spatula 28, spoon 26, or some other suitable instrument to produce musical sounds. Alternatively, a child may pick up the pan 20 and pretend that it is a banjo or guitar while stroking the ribs 121, or shake the pan 20 causing the tambourine symbols 122 to produce musical sounds. As such, a child may use the pan 20 as a xylophone, banjo, guitar or tambourine. In addition, the teapot 22 may be picked up and shook, causing the beads 160 inside the hollow body portion 154 to produce musical sounds. As such, the teapot may be used as a xylophone or musical shaker.

A child may stack the pots, pan and teapot as shown in FIGS. 2 and 3 and then rotate the handles to any desired positions. While in this stacked configuration, the child may then strike the xylophone keys in the handles with the spoon producing musical sounds. If more than one child wants to play with the stacked pots, pan and teapot, then the handles may be rotated so that one child may use the handles on one side of the stacked configuration to produce musical sounds while another child may use the handles on the other side of the configuration. Obviously, the handles may be rotated and positioned to allow more than two children to play with the xylophone keys. Alternatively, the teapot or pan, or both may be removed from the stacked configuration and used separately as a banjo, guitar, tambourine, or shaker. As a result, children may pretend that they are members of a band as each child is able to play a different pot, pan or teapot.

Figure 4:
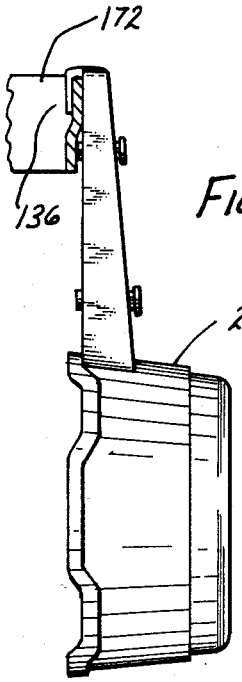
FIG. 4 is an elevational view showing how one of the pots may be hung on a belt.

The posts 12 through 18 and pan 20 may be hung on a child's belt 172 as shown in FIG. 4 using belt hooks 128 through 136. As such, a child may carry the pots or pan using his or her belt, or play musical tunes while the same are hung on the belt. This feature provides additional play options for a child.

The above description discloses the preferred embodiment of the present invention. However, persons of ordinary skill in the toy field are capable of numerous modifications once taught these principles. Accordingly, it will be understood by those skilled in the art that changes in form and details may be made to the above-described embodiment without departing from the spirit and scope of the invention.

We claim:

1. A toy musical playset comprising:

a pan having a handle musical key means for generating audible musical sounds when struck attached to said handle;

a plurality of pots gradually varying in size from a large pot to a small pot, each of said pots having a handle with said musical key means attached, said large pot capable of being stacked on top of said pan, each of said pots having means extending from one side thereof said means capable of engaging with the opposite side of an adjacent pot so that said pots are capable of being stacked on top of said pan and upon one another in descending order of size with said large pot at the bottom of said stacked pots and on top of said pan and said small pot at the top of said stacked pots; and a teapot having a handle with said musical key means, said teapot having means capable of engaging with said opposite side of said small pot.

2. The toy musical playset of claim 1 wherein said teapot is hollow and filled with beads, said beads capable of generating audible musical sounds when said teapot is shook.

3. The toy musical playset of claim 2 wherein said pan has a plurality of musical ribs attached thereto and tambourine symbols engaged to posts attached thereto.

4. The toy musical playset of claim 3 further comprising a spoon and a spatula.

5. The toy musical playset of claim 1 wherein said musical key means comprises (a) a xylophone key mounted to said handle by fasteners engaging posts of said handle and (b) foam rubber inserts located between said key and support portions of said handle, said inserts capable of cushioning said key.

6. A toy musical playset comprising:

a pan having musical ribs attached thereto, tambourine symbols engaged to posts attached thereto and a handle with a xylophone key;

a plurality of pots gradually varying in size from a large pot to a small pot, each of said pots having a handle with a xylophone key, said large pot capable of being stacked on top of said pan, each of said pots capable of being stacked on top of a larger one of said pots so that said pots are capable of being stacked on top of said pan and upon one another in descending order of size with said large pot at the bottom of said stacked pots and on top of said pan and said small pot at the top of said stacked pots;

a hollow teapot filled with beads having a handle with at least one xylophone key, said teapot capable of being stacked on top of said small pot, said beads capable of generating audible musical sounds when said teapot is shook, said pan and each of said pots having an annular portion and an annular ledge at the bottom thereof in order to facilitate stacking of said pots, said pan and said teapot, and in order to allow said pots, said pan and said teapot to be rotated with respect to each other when stacked;

a spoon; and a spatula, said spoon capable of being used with said xylophone keys in order to produce musical sounds and said spatula capable of being used with said musical ribs in order to produce musical sounds.

7. The toy musical playset of claim 7 wherein each of said handles has (a) fasteners engaged to posts of each handle mounting each xylophone key to each handle and (b) foam rubber inserts located between each xylophone key and support portions of each handle, said inserts capable of cushioning each key when struck by said spoon.

* * * * *